US011158273B1

(12) United States Patent
Li et al.

(10) Patent No.: US 11,158,273 B1
(45) Date of Patent: Oct. 26, 2021

(54) GOA DRIVING CIRCUIT AND DISPLAY DEVICE

(71) Applicant: TCL China Star Optoelectronics Technology Co., Ltd., Shenzhen (CN)

(72) Inventors: Wenfang Li, Shenzhen (CN); Xianming Zhang, Shenzhen (CN)

(73) Assignee: TCL China Star Optoelectronics Technology Co., Ltd., Guangdong (CN)

( * ) Notice: Subject to any disclaimer, the term of this patent is extended or adjusted under 35 U.S.C. 154(b) by 211 days.

(21) Appl. No.: 16/617,306

(22) PCT Filed: Nov. 12, 2019

(86) PCT No.: PCT/CN2019/117608
§ 371 (c)(1),
(2) Date: Nov. 26, 2019

(87) PCT Pub. No.: WO2021/003931
PCT Pub. Date: Jan. 14, 2021

(30) Foreign Application Priority Data

Jul. 11, 2019 (CN) ..... 201910622555.2

(51) Int. Cl.
*G09G 3/36* (2006.01)

(52) U.S. Cl.
CPC ... *G09G 3/3674* (2013.01); *G09G 2310/0289* (2013.01); *G09G 2310/08* (2013.01); *G09G 2330/021* (2013.01)

(58) Field of Classification Search
CPC ..... G09G 3/3233; G09G 3/3266; G09G 2300/0819; G09G 2300/0842;
(Continued)

(56) References Cited

U.S. PATENT DOCUMENTS

2017/0010731 A1* 1/2017 Zhang ..... G06F 3/04184
2017/0261800 A1 9/2017 Zhang et al.
(Continued)

FOREIGN PATENT DOCUMENTS

CN 105162077 A 12/2015
CN 105223713 A 1/2016
(Continued)

OTHER PUBLICATIONS

An overcurrent protection circuit of power transistor; 1996; 2 pages; Copyright 1994-2020 China Academic Journal Electronic Publishing House.

*Primary Examiner* — Nelson M Rosario
(74) *Attorney, Agent, or Firm* — Taft Stettinius & Hollister LLP

(57) ABSTRACT

A gate driver on array (GOA) driving circuit including a power management IC and a level shifter circuit connected in order, wherein the level shifter circuit at least includes a first switch transistor, a second switch transistor, a detection unit, and a clock signal output terminal, the first switch transistor is connected to the second switch transistor, and the clock signal output terminal is configured to connect to the GOA circuit, and wherein the detection unit is connected to the first switch transistor and the second switch transistor respectively, configured to detect power consumption of the first switch transistor and the second switch transistor and feedback a detection result that is configured to control an on/off state of a signal output of the power management IC.

19 Claims, 1 Drawing Sheet

(58) Field of Classification Search
CPC ... G09G 2300/0861; G09G 2310/0262; G09G 2310/0278; G09G 2310/0286
See application file for complete search history.

(56) References Cited

U.S. PATENT DOCUMENTS

| | | | | |
|---|---|---|---|---|
| 2017/0263166 | A1 | 9/2017 | Chen | |
| 2018/0218687 | A1 | 8/2018 | Su et al. | |
| 2020/0076182 | A1 | 3/2020 | Huang | |
| 2021/0209988 | A1* | 7/2021 | Wang | G09G 3/20 |

FOREIGN PATENT DOCUMENTS

| | | | |
|---|---|---|---|
| CN | 105680845 | A | 6/2016 |
| CN | 207051884 | U | 2/2018 |
| CN | 107909972 | A | 4/2018 |
| CN | 109103842 | A | 12/2018 |
| CN | 109166552 | A | 1/2019 |
| JP | 2019080436 | A | 5/2019 |
| KR | 20130104594 | A | 9/2013 |

* cited by examiner

GOA DRIVING CIRCUIT AND DISPLAY DEVICE

CROSS REFERENCE TO RELATED APPLICATIONS

This application claims priority to, and the benefit of, International Application No. PCT/CN2019/117608, filed on Nov. 12, 2019, which claims priority to, and the benefit of, Chinese Application No. 201910622555.2, filed on Jul. 11, 2019. The entire disclosures of each of the above applications are incorporated herein by reference.

FIELD OF INVENTION

The present application relates to the technical field of display, and especially to a gate driver on array (GOA) driving circuit and a display device.

BACKGROUND OF INVENTION

Cycle-by-cycle over current protection (OCP) function of conventional level shifter ICs is basically necessary, which can prevent problems such as heated wires, rising panel temperatures, and melted polarizers caused by an increased current when particles in a panel lead to a short circuit between clock signals.

Conventional methods generally add OCP at a power management IC (PMIC) terminal or level shifter IC terminal. Wherein, the PMIC terminal adopts OCP mainly at its high level output terminal (VGH) and low level output terminal (VGL), the level shifter terminal mainly performs detection to each passage, and when a greater current occurs, output of the level shifter is directly turned off to protect the whole display panel.

SUMMARY OF INVENTION

In the conventional technology, an OCP function of PMICs has insufficient precision, minor short circuits at some places might not be protected, and a level shifter IC performs real time protection to all passages.

The present application provides a GOA driving circuit and a display device, which can overcome the problem of minor short circuits at some places that cannot be protected caused by insufficient precision of an OCP function of a level shifter IC in a display panel of the conventional technology.

In order to overcome the above-mentioned technical problem, the present invention provides a GOA driving circuit, and the GOA driving circuit incudes a power management IC and a level shifter circuit connected in order, wherein the power management IC is configured to provide voltage for the level shifter circuit, and the level shifter circuit supplies power for a GOA circuit. The level shifter circuit at least includes a first switch transistor, a second switch transistor, a detection unit, and a clock signal output terminal, the first switch transistor is connected to the second switch transistor, and the clock signal output terminal is configured to connect to the GOA circuit, and wherein the detection unit is connected to the first switch transistor and the second switch transistor respectively, configured to detect power consumption of the first switch transistor and the second switch transistor and feedback a detection result to the power management IC, and the detection result is configured to control an on/off state of a signal output of the power management IC.

Beneficial effects of the present application is providing a GOA driving circuit and a display device that configures a detection unit in a level shifter circuit to respectively detect power consumption of a first switch transistor and a second switch transistor, and thereby determines if there is a problem of a short circuit in a panel and activates a wire protection function to effectively prevent melting of the display panel and realize protection of the whole display panel.

DESCRIPTION OF DRAWINGS

The accompanying figures to be used in the description of embodiments of the present application or prior art will be described in brief to more clearly illustrate the technical solutions of the embodiments or the prior art. The accompanying figures described below are only part of the embodiments of the present application, from which figures those skilled in the art can derive further figures without making any inventive efforts.

DETAILED DESCRIPTION OF PREFERRED EMBODIMENTS

The embodiments of the present application are described in detail hereinafter. Examples of the described embodiments are given in the accompanying drawings. It should be noted that, the following embodiments are intended to illustrate and interpret the present application, which shall not be construed as causing limitations to the present application. Similarly, the following embodiments are part of the embodiments of the present application and are not the whole embodiments, and all other embodiments those skilled in the art obtain without making any inventive efforts are within the scope protected by the present application.

Figure 1:
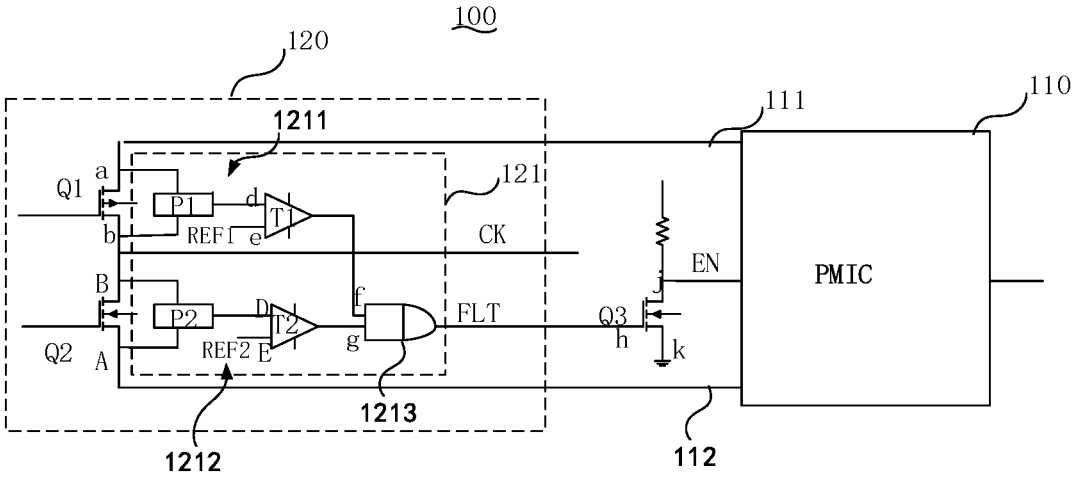
FIG. 1 is a structural schematic diagram of a gate driver on array (GOA) driving circuit according to an embodiment of the present application.

Referring to FIG. 1, FIG. 1 is a structural schematic diagram of a gate driver on array (GOA) driving circuit according to an embodiment of the present application. As shown in FIG. 1, the GOA driving circuit 100 according to the present application includes a power management integrated circuit (IC) 110 and a level shifter circuit 120 connected in order, wherein the power management IC 110 is configured to provide voltage for the level shifter circuit 120.

Selectively, the power management IC 110 according to the present application can be chips such as TNY274PN, TNY280PN, etc. and is not limited thereto. The power management IC 110 includes a first level output terminal 111, a second level output terminal 112, and an enabling signal input terminal EN. Wherein, the first level output terminal 111 is a high level output terminal (VGH), and the second level output terminal 112 is a low level output terminal (VGL). Apparently, in other embodiments, the first level output terminal 111 can also be configured as a low level output terminal, and the second level output terminal 112 can also be configured as a high level output terminal, which is not limited here. The power management IC 110 according to the present application is configured to transform alternating current of supply mains into various direct current such as 5 volts, 12 volts, etc., and input the direct current into the level shifter circuit 120.

Selectively, the level shifter circuit 120 is an integrated circuit and can amplify a voltage level. The level shifter circuit 120 supplies power for a GOA unit in a liquid crystal display panel and outputs a clock signal connected to the GOA unit. Furthermore, the level shifter circuit 120 at least includes a first switch transistor Q1, a second switch transistor Q2, a detection unit 121, and a clock signal terminal CK. The first switch transistor Q1 is connected to the second switch transistor Q2, and the clock signal terminal CK is connected to a GOA circuit. The detection unit 121 is connected to the first switch transistor Q1 and the second switch transistor Q2 respectively, configured to detect power consumption of the first switch transistor Q1 and the second switch transistor Q2 and feedback a detection result to the power management IC 110, and the detection result is configured to control an on/off state of an output of the power management IC 110.

Wherein, the first switch transistor Q1 and the second switch transistor Q2 are field-effect transistors, and in particular can be metal-oxide-semiconductor field-effect transistors (MOS transistors). In the present application, the first switch transistor Q1 is a P-channel field-effect transistor, and the second switch transistor Q2 is an N-channel field-effect transistor. In other embodiments, the first switch transistor Q1 can also be configured as an N-channel field-effect transistor, and the second switch transistor Q2 can also be configured as a P-channel field-effect transistor, which is not limited here. Selectively, a second terminal a of the first switch transistor Q1 is connected to the first level output terminal 111 of the power management IC 110, and a second terminal A of the second switch transistor Q2 is connected to the second level output terminal 112 of the power management IC 110.

Referring again to FIG. 1, an output terminal of the detection unit 121 is connected to the enabling signal input terminal EN of the power management IC 110. Selectively, the detection unit 121 further includes a first detection processing circuit 1211, a second detection processing circuit 1212, and a logic OR circuit 1213.

Wherein, the first detection processing circuit 1211 is connected to the second terminal a and a third terminal b of the first switch transistor Q1 respectively and is configured to detect and process power consumption of the first switch transistor Q1 to obtain a first detection result. In particular, the first detection processing circuit 1211 according to the present application further includes a first power monitoring circuit P1 and a first comparator circuit T1, Wherein, the first power monitoring circuit P1 is configured to monitor power consumption of the first switch transistor Q1, and in one embodiment, power consumption of the first switch transistor Q1 can also be directly monitored by using a power meter. Selectively, a first connection terminal of the first power monitoring circuit P1 is connected to the second terminal a of the first switch transistor Q1, a second connection terminal of the first power monitoring circuit P1 is connected to the third terminal b of the first switch transistor Q1, and a first output terminal of the first power monitoring circuit P1 is connected to a first terminal d of the first comparator circuit T1. A second terminal e of the first comparator circuit T1 is connected to a first reference signal REF1, and an output terminal of the first comparator circuit T1 is connected to a first terminal f of the logic OR circuit 1213.

Selectively, the second detection processing circuit 1212 is connected to the second terminal A and a third terminal B of the second switch transistor Q2 respectively and is configured to detect and process power consumption of the second switch transistor Q2 to obtain a second detection result. In particular, the second detection processing circuit 1212 according to the present application further includes a second power monitoring circuit P2 and a second comparator circuit T2, Wherein, the second power monitoring circuit P2 is configured to monitor power consumption of the second switch transistor Q2, and in one embodiment, power consumption of the second switch transistor Q2 can also be directly monitored by using a power meter. Selectively, a first connection terminal of the second power monitoring circuit P2 is connected to the second terminal A of the second switch transistor Q2, a second connection terminal of the second power monitoring circuit P2 is connected to the third terminal B of the second switch transistor Q2, and a first output terminal of the second power monitoring circuit P2 is connected to a first terminal D of the second comparator circuit T2. A second terminal E of the second comparator circuit T2 is connected to a second reference signal REF2, and an output terminal of the second comparator circuit T2 is connected to a second terminal g of the logic OR circuit 1213.

Selectively, the first detection result and the second detection result respectively processed and output by the first detection processing circuit 1211 and the second detection processing circuit 1212 are respectively input into the logic OR circuit 1213, processed by the logic OR circuit 1213 and output a final detection result to the enabling signal input terminal EN of the power management IC 110 to control an on/off state of a signal output of the power management IC 110.

Referring continually to FIG. 1, the GOA circuit according to the present application further includes a third switch transistor Q3, wherein a first terminal h of the third switch transistor Q3 is connected to an output terminal FLT of the logic OR circuit 1213 in the detection unit 121, a second terminal j of the third switch transistor Q3 is connected to the enabling signal input terminal EN of the power management IC 110, and a third terminal k of the third switch transistor Q3 is grounded. Being the same as the first switch transistor Q1 and the second switch transistor Q2, the third switch transistor Q3 according to the present application is also a field-effect transistor, in particular can be an N-channel field-effect transistor, and in other embodiments, apparently, can also be a P-channel field-effect transistor, which is not limited here.

The following, with reference to FIG. 1, describes in detail principles of a GOA driving circuit according to an embodiment of the present application, and the present embodiment illustrates in detail with the second switch transistor Q2 and the third switch transistor Q3 being N-channel field-effect transistors, and the first switch transistor Q1 being a P-channel field-effect transistor, as the following.

It can be understood that, in a liquid crystal display panel, when wires in the panel short, a stable high value current will occur. The present application takes advantage of fixed resistance of the first switch transistor Q1 and the second switch transistor Q2 (a PMOS transistor and an NMOS transistor respectively in the present application) connected to the clock signal output terminal CK, configures the detection unit 121 in the level shifter circuit 120 to respectively detect power consumption of the first switch transistor Q1 and the second switch transistor Q2, and thereby determines if there is a problem of a short circuit and activates a wire protection function to prevent melting of the display panel.

In particular, when there is a short circuit in a display panel, a current of the clock signal output terminal CK will increase, and correspondingly power consumption of the first switch transistor Q1 and the second switch transistor Q2 will also increase. At this time, measuring power consumption of the first switch transistor Q1 and the second switch transistor Q2 respectively by the first power monitoring circuit P1 and the second power monitoring circuit P2, and inputting the power consumption of the first switch transistor Q1 and the second switch transistor Q2 to the first comparator circuit T1 and the second comparator circuit T2, respectively. The first comparator circuit T1 and the second comparator circuit T2 compare the power consumption value of the first switch transistor Q1 and the second switch transistor Q2 with the first reference signal REF1 and the second reference signal REF2, respectively. If the power consumption value of the first switch transistor Q1 and the second switch transistor Q2 are greater than the first reference signal REF1 and the second reference signal REF2, respectively, then the first comparator circuit T1 and the second comparator circuit T2 respectively output 1. Similarly, If the power consumption value of the first switch transistor Q1 and the second switch transistor Q2 are less than the first reference signal REF1 and the second reference signal REF2, respectively, then the first comparator circuit T1 and the second comparator circuit T2 respectively output 0. Wherein, a case when the first comparator circuit T1 outputs 1 indicates that the first switch transistor Q1 has a high value current, and a case when the second comparator circuit T2 outputs 1 indicates that the second switch transistor Q2 has a high value current.

Selectively, either the first comparator circuit T1 or the second comparator circuit T2 outputs 1, the output terminal FLT of the logic OR circuit 1213 will be set to a high level, which indicates there is a high value current in the panel, that is, there is a short circuit in the panel. At this time, the output terminal FLT of the logic OR circuit 1213 is a high level, the first terminal h of the third switch transistor Q3 turns on, and the enabling signal input terminal EN of the power management IC 110 is set to a low level through the third terminal k of the third switch transistor Q3, which therefore turns off output of the power management IC 110 and prevents panel melting.

The above-mentioned embodiment configures a detection unit in a level shifter circuit to respectively detect power consumption of a first switch transistor and a second switch transistor, and thereby determines if there is a problem of a short circuit in a panel and activates a wire protection function to effectively prevent melting of the display panel and realize protection of the whole display panel.

Figure 2:
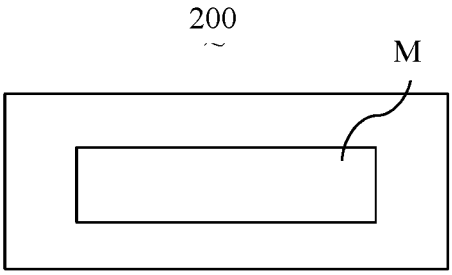
FIG. 2 is a structural schematic diagram of a display device according to an embodiment of the present application.

Referring to FIG. 2, FIG. 2 is a structural schematic diagram of a display device according to an embodiment of the present application. As shown in FIG. 2, the display device 200 according to the present application includes the GOA driving circuit M described in the above-mentioned first embodiment and second embodiment, structures and principles of the GOA driving circuit M are described in detail in the above-mentioned embodiments, and repeated description is omitted here.

In summary, those skilled in the art can readily understand that the present application provides a GOA driving circuit and a display device that configures a detection unit in a level shifter circuit to respectively detect power consumption of a first switch transistor and a second switch transistor, and thereby determines if there is a problem of a short circuit in a panel and activates a wire protection function to effectively prevent melting of the display panel and realize protection of the whole display panel.

The present application has been described with a preferred embodiment thereof. The preferred embodiment is not intended to limit the present application, and it is understood that many changes and modifications to the described embodiment can be carried out without departing from the scope and the spirit of the application that is intended to be limited only by the appended claims.

What is claimed is:

1. A gate driver on array (GOA) driving circuit, comprising a power management integrated circuit (IC) and a level shifter circuit connected in order, wherein the power management IC is configured to provide voltage for the level shifter circuit, and the level shifter circuit supplies power for a GOA circuit;

wherein the level shifter circuit comprises a first switch transistor, a second switch transistor, a detection unit, and a clock signal output terminal; the first switch transistor is connected to the second switch transistor, and the clock signal output terminal is configured to connect to the GOA circuit, wherein the detection unit is connected to the first switch transistor and the second switch transistor, configured to detect power consumption of the first switch transistor and the second switch transistor and feedback a detection result to the power management IC, and the detection result is configured to control an on/off state of a signal output of the power management IC;

wherein the power management IC comprises a first level output terminal, a second level output terminal, and an enabling signal input terminal, the first level output terminal is connected to a second terminal of the first switch transistor, the second level output terminal is connected to a second terminal of the second switch transistor, the enabling signal input terminal is connected to an output terminal of the detection unit, the first level output terminal of the power management IC is a high level output terminal, and the second level output terminal of the power management IC is a low level output terminal;

wherein the detection unit comprises a first detection processing circuit, a second detection processing circuit, and a logic OR circuit, the first detection processing circuit is connected to the second terminal and a third terminal of the first switch transistor and is configured to detect and process power consumption of the first switch transistor to obtain a first detection result, the second detection processing circuit is connected to the second terminal and a third terminal of the second switch transistor and is configured to detect and process power consumption of the second switch transistor to obtain a second detection result, and the first detection result and the second detection result are respectively input to a first terminal and a second terminal of the logic OR circuit, processed by the logic OR circuit and output the detection result to the enabling signal input terminal of the power management IC.

2. A gate driver on array (GOA) driving circuit, comprising a power management integrated circuit (IC) and a level shifter circuit connected in order, wherein the power management IC is configured to provide voltage for the level shifter circuit, and the level shifter circuit supplies power for a GOA circuit;

wherein the level shifter circuit comprises a first switch transistor, a second switch transistor, a detection unit, and a clock signal output terminal, the first switch transistor is connected to the second switch transistor, and the clock signal output terminal is configured to connect to the GOA circuit, and wherein the detection unit is connected to the first switch transistor and the second switch transistor, configured to detect power consumption of the first switch transistor and the second switch transistor and feedback a detection result to the power management IC, and the detection result is configured to control an on/off state of a signal output of the power management IC.

3. The GOA driving circuit as claimed in claim 2, wherein the power management IC comprises a first level output terminal, a second level output terminal, and an enabling signal input terminal, the first level output terminal is connected to a second terminal of the first switch transistor, the second level output terminal is connected to a second terminal of the second switch transistor, and the enabling signal input terminal is connected to an output terminal of the detection unit.

4. The GOA driving circuit as claimed in claim 3, wherein the detection unit comprises a first detection processing circuit, a second detection processing circuit, and a logic OR circuit;

wherein the first detection processing circuit is connected to the second terminal and a third terminal of the first switch transistor and is configured to detect and process power consumption of the first switch transistor to obtain a first detection result, the second detection processing circuit is connected to the second terminal and a third terminal of the second switch transistor and is configured to detect and process power consumption of the second switch transistor to obtain a second detection result, and the first detection result and the second detection result are respectively input to a first terminal and a second terminal of the logic OR circuit, processed by the logic OR circuit and output the detection result to the enabling signal input terminal of the power management IC.

5. The GOA driving circuit as claimed in claim 4, wherein the first detection processing circuit comprises a first power monitoring circuit and a first comparator circuit;

wherein a first connection terminal of the first power monitoring circuit is connected to the second terminal of the first switch transistor, a second connection terminal of the first power monitoring circuit is connected to the third terminal of the first switch transistor, and a first output terminal of the first power monitoring circuit is connected to a first terminal of the first comparator circuit;

wherein a second terminal of the first comparator circuit is connected to a first reference signal, and an output terminal of the first comparator circuit is connected to a first terminal of the logic OR circuit.

6. The GOA driving circuit as claimed in claim 4, wherein the second detection processing circuit comprises a second power monitoring circuit and a second comparator circuit;

wherein a first connection terminal of the second power monitoring circuit is connected to the second terminal of the second switch transistor, a second connection terminal of the second power monitoring circuit is connected to the third terminal of the second switch transistor, and a second output terminal of the second power monitoring circuit is connected to a first terminal of the second comparator circuit;

wherein a second terminal of the second comparator circuit is connected to a second reference signal, and an output terminal of the second comparator circuit is connected to a second terminal of the logic OR circuit.

7. The GOA driving circuit as claimed in claim 4, further comprising a third switch transistor, wherein a first terminal of the third switch transistor is connected to an output terminal of the logic OR circuit in the detection unit, a second terminal of the third switch transistor is connected to the enabling signal input terminal of the power management IC, and a third terminal of the third switch transistor is grounded.

8. The GOA driving circuit as claimed in claim 7, wherein the first switch transistor, the second switch transistor, and the third switch transistor are field-effect transistors.

9. The GOA driving circuit as claimed in claim 8, wherein the second switch transistor and the third switch transistor are N-channel field-effect transistors, and the first switch transistor is a P-channel field-effect transistor.

10. The GOA driving circuit as claimed in claim 3, wherein the first level output terminal of the power management IC is a high level output terminal, and the second level output terminal of the power management IC is a low level output terminal.

11. A display device, comprising a gate driver on array (GOA) driving circuit comprising a power management integrated circuit (IC) and a level shifter circuit connected in order, wherein the power management IC is configured to provide voltage for the level shifter circuit, and the level shifter circuit supplies power for a GOA circuit;

wherein the level shifter circuit comprises a first switch transistor, a second switch transistor, a detection unit, and a clock signal output terminal, the first switch transistor is connected to the second switch transistor, and the clock signal output terminal is configured to connect to the GOA circuit, and wherein the detection unit is connected to the first switch transistor and the second switch transistor, configured to detect power consumption of the first switch transistor and the second switch transistor and feedback a detection result to the power management IC, and the detection result is configured to control an on/off state of a signal output of the power management IC.

12. The GOA driving circuit as claimed in claim 11, wherein the power management IC comprises a first level output terminal, a second level output terminal, and an enabling signal input terminal, the first level output terminal is connected to a second terminal of the first switch transistor, the second level output terminal is connected to a second terminal of the second switch transistor, and the enabling signal input terminal is connected to an output terminal of the detection unit.

13. The GOA driving circuit as claimed in claim 12, wherein the detection unit comprises a first detection processing circuit, a second detection processing circuit, and a logic OR circuit;

wherein the first detection processing circuit is connected to the second terminal and a third terminal of the first switch transistor and is configured to detect and process power consumption of the first switch transistor to obtain a first detection result, the second detection processing circuit is connected to the second terminal and a third terminal of the second switch transistor and is configured to detect and process power consumption of the second switch transistor to obtain a second detection result, and the first detection result and the second detection result are respectively input to a first terminal and a second terminal of the logic OR circuit, processed by the logic OR circuit and output the detection result to the enabling signal input terminal of the power management IC.

14. The GOA driving circuit as claimed in claim 13, wherein the first detection processing circuit comprises a first power monitoring circuit and a first comparator circuit;

wherein a first connection terminal of the first power monitoring circuit is connected to the second terminal of the first switch transistor, a second connection terminal of the first power monitoring circuit is connected to the third terminal of the first switch transistor, and a first output terminal of the first power monitoring circuit is connected to a first terminal of the first comparator circuit;

wherein a second terminal of the first comparator circuit is connected to a first reference signal, and an output terminal of the first comparator circuit is connected to a first terminal of the logic OR circuit.

15. The GOA driving circuit as claimed in claim 13, wherein the second detection processing circuit comprises a second power monitoring circuit and a second comparator circuit;

wherein a first connection terminal of the second power monitoring circuit is connected to the second terminal of the second switch transistor, a second connection terminal of the second power monitoring circuit is connected to the third terminal of the second switch transistor, and a second output terminal of the second power monitoring circuit is connected to a first terminal of the second comparator circuit;

wherein a second terminal of the second comparator circuit is connected to a second reference signal, and an output terminal of the second comparator circuit is connected to a second terminal of the logic OR circuit.

16. The GOA driving circuit as claimed in claim 13, further comprising a third switch transistor, wherein a first terminal of the third switch transistor is connected to an output terminal of the logic OR circuit in the detection unit, a second terminal of the third switch transistor is connected to the enabling signal input terminal of the power management IC, and a third terminal of the third switch transistor is grounded.

17. The GOA driving circuit as claimed in claim 16, wherein the first switch transistor, the second switch transistor, and the third switch transistor are field-effect transistors.

18. The GOA driving circuit as claimed in claim 17, wherein the second switch transistor and the third switch transistor are N-channel field-effect transistors, and the first switch transistor is a P-channel field-effect transistor.

19. The GOA driving circuit as claimed in claim 12, wherein the first level output terminal of the power management IC is a high level output terminal, and the second level output terminal of the power management IC is a low level output terminal.

* * * * *